US005993962A

United States Patent [19]

Timm et al.

[11] Patent Number: 5,993,962

[45] Date of Patent: Nov. 30, 1999

[54] RESEALABLE PACKAGING SYSTEM

[75] Inventors: Larry S. Timm, Milwaukee; Tim E. Bublitz, West Allis, both of Wis.

[73] Assignee: Ato Findley, Inc., Milwaukee, Wis.

[21] Appl. No.: 08/584,350

[22] Filed: Jan. 11, 1996

[51] Int. Cl.[6] ..... B32B 7/12; B32B 27/08

[52] U.S. Cl. ..... 428/354; 428/349; 428/517; 428/518; 428/519

[58] Field of Search ..... 428/40, 349, 354, 428/517, 518, 519

[56] References Cited

U.S. PATENT DOCUMENTS

| | | | |
|---|---|---|---|
| 3,406,039 | 10/1968 | Paufler | 117/76 |
| 4,673,601 | 6/1987 | Lamping et al. | 428/354 X |
| 5,089,320 | 2/1992 | Straus et al. | 428/216 |
| 5,384,472 | 1/1995 | Yanidis et al. | 428/349 |

*Primary Examiner*—Daniel Zirker
*Attorney, Agent, or Firm*—Nicholas A. Kees; Godfrey & Kahn, S.C.

[57] ABSTRACT

A resealable packaging system, providing a multiple reseal capability. A strip of pressure sensitive adhesive is applied over a first area of a substrate. Then a strip of cold seal adhesive is layered over the strip of pressure sensitive adhesive. A strip of cold seal adhesive is then applied to a second area of the substrate, or to another substrate, whether of the same or a different type. The materials are chosen so that, when the substrate is aligned and the strips of cold seal adhesive bonded together, the bond formed between the strips of cold seal adhesive, and the bond between the pressure sensitive adhesive and the cold seal adhesive, and the bond between the cold seal adhesive and the substrate, are stronger than the bond between the substrate and the pressure sensitive adhesive. Thus, when the two areas of substrate, now bonded together by the cold seal adhesive, are peeled apart, the pressure sensitive adhesive remains with the cold seal adhesive and is exposed. A multiple reseal capability is thereby provided, with the surface of one substrate thus substantially freed of adhesive to facilitate removal and repackaging of the package contents.

19 Claims, 1 Drawing Sheet

RESEALABLE PACKAGING SYSTEM

BACKGROUND OF THE INVENTION

This invention relates to packaging systems, and in particular to packaging systems that can be sealed, opened, and then resealed multiple times.

Examples of prior inventions for providing resealable packaging material are shown in U.S. Pat. Nos. 3,406,039, 5,089,320 and 5,382,472. Each of these inventions, however, has its respective disadvantages.

SUMMARY OF THE INVENTION

The invention provides a resealable packaging system, including one or more substrates. These substrates could be either both relatively flexible, both relatively rigid, or one relatively flexible and one more relatively rigid. A layer of pressure sensitive adhesive (PSA) is applied over a first area of the substrate. Then a layer of cold seal adhesive is applied over the layer of PSA. A layer of cold seal adhesive is also applied to a second area of the substrate or to a second substrate. The materials are chosen, or modified, so that when the two portions of substrate, or two substrates, are aligned and the layers of cold seal adhesive bonded together, the bonds formed between the two areas of cold seal adhesive, and between the PSA and the cold seal adhesive, and between the cold seal adhesive and the second substrate, are stronger than the bond between the substrate and the PSA. Thus, when the two areas of substrate, now bonded together by the cold seal adhesive, are peeled apart, the PSA is cleanly and completely exposed. A multiple reseal capability, with significant advantages over present state of the art systems, is thereby provided, wherein one substrate is substantially clean of PSA and substantially all of the PSA remains with the other substrate.

Other and further objects and advantages of the invention will become apparent hereinafter.

DESCRIPTION OF THE PREFERRED EMBODIMENTS

Figure 1:
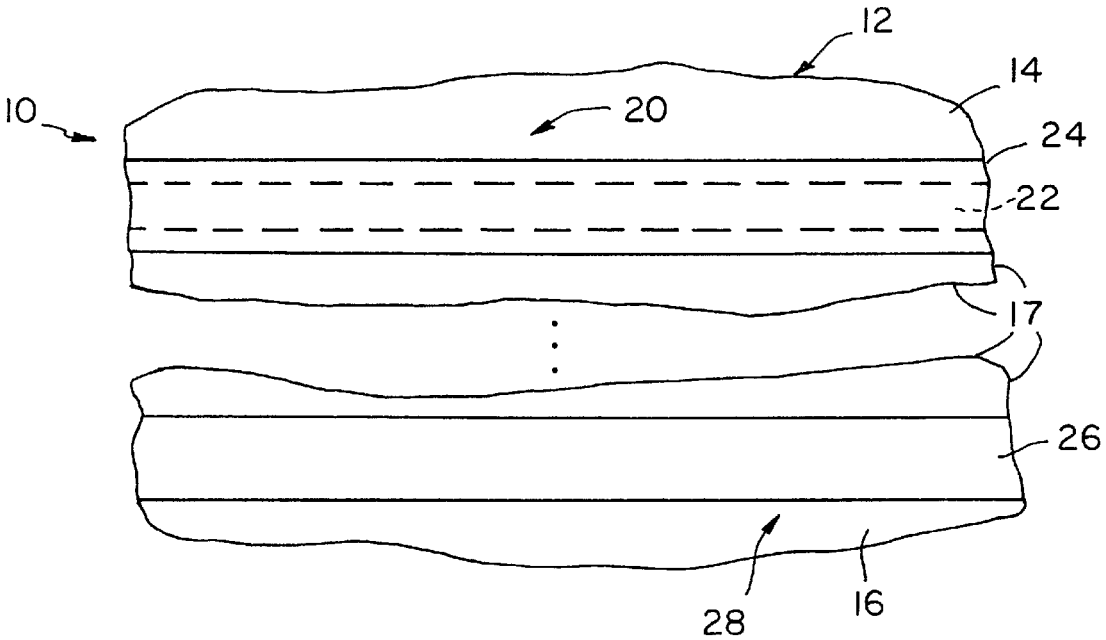
FIG. 1 is a top view of a packaging material constructed according to a preferred embodiment of the invention.

Referring now to FIG. 1, there is shown a packaging material 10 constructed according to a preferred embodiment of the invention. In one embodiment the packaging material 10 is constructed of a relatively continuous substrate 12, of which sections 14, 16 or portions are selected. The sections 14, 16 are shown with torn edges 17, and are of undetermined width, with the center 18 of the substrate 12, or the space between the sections 14, 16, having been removed from the drawing for space considerations. In an alternative embodiment, section 16 is a section of a different or separate substrate, rather than being part of the same substrate 12.

The substrate 12 itself is generally assumed to be formed of some type of thin material which may be relatively flexible, or relatively rigid. A preferred material would be a plastic film, such as polyethylene, polypropylene, polyesters, polystyrene, nylon, polycarbonates, cellophane, ethylene vinyl acetates, ethylene vinyl alcohols, polyvinyl alcohols, polyvinyl chloride, polyvinylidene chloride, polyacrylonitrile, alpha olefins, polyvinyl butyrate, cellose acetate butyrate, or cellulose acetate propionate. Alternatively, depending upon the conditions and other materials selected, it is possible that the substrate 12 could be formed of paper and paper products, including boardstock, clay coated SBS, corrugated, and chipboard. Another alternative is to form the substrate 12 of metal foil. Yet another alternative would be to form the substrate 12 of some laminate, formed of more than one layer. It should also be made clear that, if the section 16 is a portion of a different substrate, it is not required that the material of that substrate be of the same material as substrate 12. In fact, if the section 16 is a portion of a different substrate, it could even be a rigid substrate when substrate 12 is flexible, or flexible when substrate 12 is rigid.

Referring again specifically to FIG. 1, the substrate 12 acts as a substrate for the materials to be applied as will be described presently. In a predetermined area 20 of the substrate 12, there is applied a strip 22, or other predetermined shape, of pressure sensitive adhesive (PSA) 22 of predetermined dimensions. The PSA strip 22 is positioned within area 20, and the area 20 itself selected, depending upon several criteria including the product being packaged in the packaging material 10, the type of package, and the design of the package, that is, how the package is meant to look, the shape of the package and the product being packaged, and how the package is intended to open. Depending upon these and other considerations, the PSA 22 could be formulations containing acrylic, acrylic copolymers, natural rubber, styrene butadiene rubbers, neoprene, vinyl acetate ethylene and copolymers, polyurethanes, styrene block copolymers, silicones, amorphous poly alpha olefins, polyamides, polyesters, polyisoprenes and tackified elastomers.

Also applied to the substrate 12 is a first strip 24, or other predetermined area, of cold seal adhesive. The cold seal adhesive could be based upon the following chemistries: polyisoprene, natural rubber, neoprene, urethanes, acrylics, vinyl acetate ethylenes, styrene butadiene rubber, tackified elastomers, and ethylene vinyl chloride copolymers. First strip 24 of cold seal adhesive is applied over the PSA strip 22, shaped and positioned to completely cover the PSA. For most aesthetic use of the invention, and to make the invention most usable in roll form, the width of the first strip 24 of cold seal adhesive may be just a bit wider than the strip 22 of PSA. A second strip 26, or other predetermined shape, of cold seal adhesive is applied in a predetermined area 28 of the section 16, the area 28 again selected depending upon the product being packaged in the packaging material 10 and the other packaging considerations enumerated above. It is not necessary that the two strips of cold seal adhesive be of the same material, but it is most functional if they are of substantially matching shape and size. The materials are to be selected to provide the most beneficial performance characteristics.

Prior to use, the packaging material 10 is generally handled and transported in the form of a roll. Accordingly it is advantageous, to ensure that the surface of the substrate 12 to which adhesives are not applied does not unduly stick to the cold seal adhesive on the adjacent layer of packaging material while on the roll, to apply a release coating or treatment to the surface to prevent such undue adhesion or blocking, as is already customary in the use of cold seal adhesives. As shown best in FIG. 2, treatments 30, 32 may be applied to sections 14, 16, to control adhesion, that is, to increase or decrease adhesion, as desired and as applicable. For instance, the sides to which the cold seal adhesive 24, 26 is applied could be treated to improve or enhance adhesion if that was deemed necessary or desirable, while the opposite sides could be treated to reduce adhesion and thereby prevent roll blocking.

Examples of such treatments are such coatings are organic coatings including acrylic, polyvinylidene chloride and copolymers, polyethylene, silicone, ethylene vinyl acetate, polyamide, polyethylene amine, polystyrene, ethylene vinyl alcohol, polyvinyl alcohol, polyurethane, silane, fluorocarbon and wax. Depending upon the conditions and other selections, it may also be possible to use inorganic coatings including metallized or oxide coatings. Also available are surface treatments including corona treatments, flame treatments, additive treatments, and chemical treatments.

Figure 2:
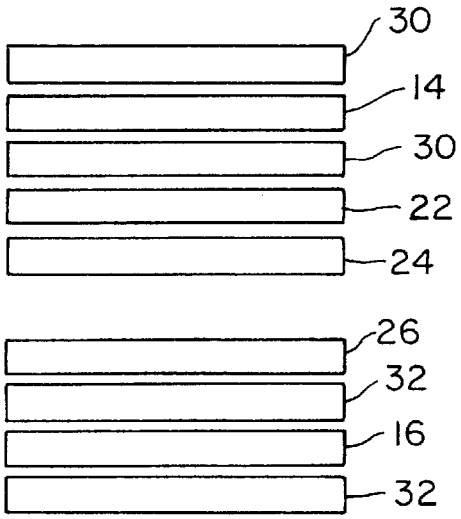
FIG. 2 is a side view, somewhat schematic and greatly enlarged to show detail, of the packaging material shown in FIG. 1, in an aligned position and ready to be bonded the first time.
Figure 3:
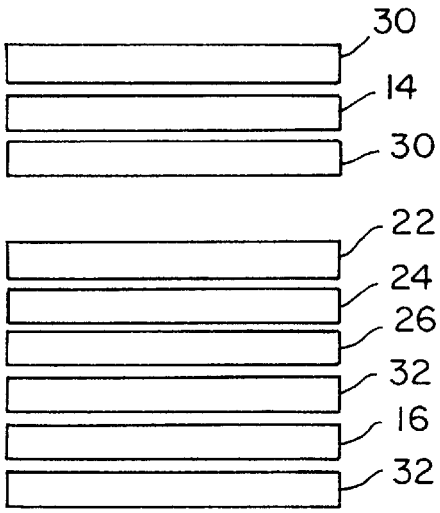
FIG. 3 is a side view, similar to FIG. 2, of the packaging material constructed according to a preferred embodiment of the invention, with the material having been bonded once and peeled apart, and ready to be resealed.

In use, then, the packaging material 10 is removed from rolls (not shown), wrapped about the product to be packaged, and the two cold seal adhesive strips 24, 26 are aligned as shown in FIG. 2. The two strips 24, 26 are then pressed together and thereby bonded, sealing the product inside the packaging material. When the package is to be opened, the two sections 14, 16 are pulled apart as shown in FIG. 3. It is critical to the proper functioning of the invention that the materials be selected so that the bonds between the two strips 24, 26 of cold seal adhesive, and between the PSA 22 and the cold seal adhesive 24, and between the cold seal adhesive 26 and the substrate section 16, are stronger than the bond between the PSA and the substrate section 14. This intended difference in bonding strength produces the effect shown in FIG. 3, wherein the PSA 22 is peeled cleanly off the substrate section 14, exposing the PSA, while the two strips 24, 26 of cold seal adhesive remain bonded together. This exposing of the PSA 22 provides a package which is readily resealable multiple times, without substantial reduction in bond strength, and provides one non-adhesive surface for withdrawing or repackaging the contents of the package.

It is important to select or treat the substrate section 14 to ensure that substantially all the PSA peels off the section. This is because it is more aesthetic, as compared to leaving part of the PSA on each side, and because one of the surfaces may be the one over which food may pass, and it would be more advantageous if that surface were not the one with any PSA on it.

EXAMPLE

A resealable closure was achieved by first selecting, as a substrate, a 60 gauge metalized polypropylene film, commercially available as PC-1 from Toray Plastics (America), Inc., this film having been adhesive laminated to 100 gauge T523 polypropylene film manufactured by AET Packaging Films, a Division of Applied Extrusion Technologies, Inc., said film having had applied a cold seal release coating, V#101884 from Zeneca Specialty Inks, to ensure subsequent unwind, or non-blocking to the sealant system in converted roll form. An area of waterborne acrylic-based pressure sensitive polymer, with a Tg of −45° C. and a viscosity of 115 centipoise, was coated onto the non-metalized side of the substrate at 5 grams per square meter (3# dry/ream). A commercially available pressure sensitive adhesive (PSA) was used, Carbotac #26207 from the B.F. Goodrich Company, Specialty Polymers & Chemicals Division. Next, the PSA, and an area of the substrate to be later aligned and sealed, were overcoated with five grams per square meter (dry weight) of a waterborne cold seal adhesive, NIP-WELD® C7089, available from Findley Adhesives, Inc., which was developed for use on polypropylene film. Each of these coatings with adhesive was accomplished by means of commercial rotogravure processes. The cold seal adhesive applied directly to the base sheet was then aligned with the cold seal applied over the PSA. The two cold seal areas were bonded together using mechanical pressure, comprising serrated sealing jaws pressed together at 80 psi, employing a ½ second dwell. The resulting bond strength was measured at 400+ grams per 25 mm (inch). When the films were peeled apart, the sealant failure mode exposed a film of pressure sensitive adhesive, which with only hand or finger pressure provided a reseal capability. Testing reseal viability by use of a 4½ pound weighted roller, demonstrated in excess of ten subsequent reclosures, providing a consistent 4 oz./inch (100–120 gram/25 mm) performance.

This example illustrates the preparation of packaging material employing the present invention. Adding appropriate printing and commercial graphics would facilitate this material being used to wrap any number of comestible or non-food items, where an easy to use, cost efficient, multiple package reclosure is desired.

While the system hereinbefore described is effectively adapted to fulfill the aforesaid objects, it is to be understood that the invention is not intended to be limited to the specific preferred embodiments of resealable packaging system set forth above. Rather, it is to be taken as including all reasonable equivalents to the subject matter of the appended claims.

We claim:

1. A resealable packaging material, comprising:

a substrate;

a strip of pressure sensitive adhesive applied over a first area of said substrate;

a first strip of cold seal adhesive applied over said layer of pressure sensitive adhesive; and a second strip of cold seal adhesive applied over a second area of said substrate;

such that, when said strips of cold seal adhesive are aligned to bond them together, the bond formed between them, and the bond between the cold seal adhesive and the pressure sensitive adhesive, and the bond between the cold seal and the second area of said substrate, are all stronger than the bond between the first area of substrate and the pressure sensitive adhesive, resulting in the entire removal of the pressure sensitive adhesive from the first area of substrate when the two areas of substrate are peeled apart, thereby providing a multiple reseal capability.

2. A resealable packaging material as recited in claim 1, further comprising the surface of the substrate being treated so as to ensure that the bond between the pressure sensitive adhesive and the first area of substrate is weaker than the bond between the two layers of cold seal adhesive and the bond between the cold seal adhesive and the second area of substrate and the bond between the cold seal adhesive and the pressure sensitive adhesive.

3. A resealable packaging material as recited in claim 2 wherein the substrate is treated to control adhesion.

4. A resealable packaging material as recited in claim 2 wherein the substrate is treated by coating it with an organic coating selected from the group consisting of acrylic, polyvinylidene chloride and copolymers, polyethylene, silicone, ethylene vinyl acetate, polyamide, polyethylene imine, polystyrene, ethylene vinyl alcohol, polyvinyl alcohol, polyurethane, silane, fluorocarbon, wax.

5. A resealable packaging material as recited in claim 2 wherein the substrate is treated by coating it with an inorganic or metallic coating selected from the group consisting of metallized or oxide coating.

6. A resealable packaging material as recited in claim 2 wherein the substrate is treated by one of the treatments selected from the group consisting of corona treating, flame treating, additive treating, and chemical treating.

7. A resealable packaging material as recited in claim 1 wherein the first strip of cold seal adhesive is wider than the strip of pressure sensitive adhesive.

8. A resealable packaging material as recited in claim 1 wherein the first and second strips of cold seal adhesive are formed of the same material.

9. A resealable packaging material as recited in claim 1 wherein the substrate is flexible.

10. A resealable package, comprising:

first and second substrates;

a strip of pressure sensitive adhesive applied over a predetermined area of said first substrate;

a first strip of cold seal adhesive applied over said layer of pressure sensitive adhesive; and a second strip of cold seal adhesive applied over a predetermined area of said second substrate;

such that, when the substrates are aligned to bond the strips of cold seal adhesive together, the bond formed between them, and the bond between the cold seal adhesive and the pressure sensitive adhesive, and the bond between the second substrate and the cold seal adhesive, are all stronger than the bond between the first substrate and the pressure sensitive adhesive, resulting in the substantially entire removal of the pressure sensitive adhesive from the first substrate when the two substrates are peeled apart, thereby providing a multiple reseal capability.

11. A resealable package as recited in claim 10, further comprising the surface of both substrates being treated so as to ensure that the bond between the pressure sensitive adhesive and the substrate is weaker than the bond between the two layers of cold seal adhesive and the bond between the cold seal adhesive and the pressure sensitive adhesive and the bond between the second substrate and the cold seal adhesive.

12. A resealable package as recited in claim 11 wherein at least one of the substrates is treated to control adhesion.

13. A resealable package as recited in claim 11 wherein at least one substrate is treated by coating it with an organic coating selected from the group consisting of acrylic, polyvinylidene chloride and copolymers, polyethylene, silicone, ethylene vinyl acetate, polyamide, polyethylene imine, polystyrene, ethylene vinyl alcohol, polyvinyl alcohol, polyurethane, silane, fluorocarbon, wax.

14. A resealable package as recited in claim 11 wherein at least one substrate is treated by coating it with an inorganic or metallic coating selected from the group consisting of metallized or oxide coating.

15. A resealable package as recited in claim 11 wherein at least one substrate is treated by one of the treatments selected from the group consisting of corona treating, flame treating, additive treating, and chemical treating.

16. A resealable package as recited in claim 10 wherein the first strip of cold seal adhesive is wider than the strip of pressure sensitive adhesive.

17. A resealable package as recited in claim 10 wherein the first and second strips of cold seal adhesive are formed of the same material.

18. A resealable package as recited in claim 10 wherein at least one of the substrates is flexible.

19. A resealable package as recited in claim 10 wherein at least one of the substrates is rigid.

* * * * *